US010879024B2

(12) United States Patent
Famy et al.

(10) Patent No.: US 10,879,024 B2
(45) Date of Patent: Dec. 29, 2020

(54) SYSTEM FOR ACTUATING A VACUUM BOTTLE

(71) Applicant: Schneider Electric Industries SAS, Rueil Malmaison (FR)

(72) Inventors: François Famy, Claix (FR); Emmanuel Kuentz, Claix (FR); Pierre Newinger, Saint Joseph de Rivière (FR); Denis Milan, Voiron (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 0 days.

(21) Appl. No.: 16/654,809

(22) Filed: Oct. 16, 2019

(65) Prior Publication Data

US 2020/0176205 A1 Jun. 4, 2020

(30) Foreign Application Priority Data

Dec. 4, 2018 (FR) ..... 18 72271

(51) Int. Cl.
*H01H 33/666* (2006.01)

(52) U.S. Cl.
CPC ..... *H01H 33/666* (2013.01)

(58) Field of Classification Search
CPC ..... H01H 33/666; H01H 33/6661; H01H 2033/66246; H01H 2033/66253;
(Continued)

(56) References Cited

U.S. PATENT DOCUMENTS 5,449,868 A * 9/1995 Monson ..... H01H 33/666 218/118
5,808,258 A * 9/1998 Luzzi ..... H01H 33/66207 218/136

(Continued)

FOREIGN PATENT DOCUMENTS

DE 1083889 6/1960
DE 102005032709 1/2007

(Continued)

OTHER PUBLICATIONS

French Preliminary Search Report and Written Opinion for French Patent Application Publication No. FR1872271, dated Sep. 2, 2019, 9 pages.

(Continued)

*Primary Examiner* — William A Bolton
(74) *Attorney, Agent, or Firm* — Locke Lord LLP

(57) ABSTRACT

A system for actuating a vacuum bottle of an electrical device, the vacuum bottle comprising a fixed electrode and a moving electrode that is mobile along a longitudinal axis between a closed position and an open position. The actuating system comprises an adjusting nut that is rotatably mobile about the longitudinal axis and driven by a drive device to perform an opening movement of the moving electrode, and an adjusting screw engaging with the adjusting nut in order to vary the moment when the drive device drives the moving electrode. The moving electrode is constrained to translate along the longitudinal axis with the adjusting screw, but is free to rotate relative to the adjusting screw, and the rotation of the adjusting screw is limited by blocking means.

10 Claims, 2 Drawing Sheets

(58) Field of Classification Search
CPC ..... H01H 31/003; H01H 33/66238; H01H 31/00; H01H 31/08; H01H 33/50; H01H 33/52
USPC ..... 218/140, 153, 154, 120, 118
See application file for complete search history.

(56) References Cited

U.S. PATENT DOCUMENTS

| | | | | |
|---|---|---|---|---|
| 6,649,854 | B1 * | 11/2003 | Bauer | H01H 33/666 218/120 |
| 6,753,493 | B2 * | 6/2004 | Rhein | H01H 33/6662 218/120 |
| 7,053,327 | B2 * | 5/2006 | Benke | H01H 33/666 218/120 |
| 10,217,581 | B2 * | 2/2019 | Famy | H01H 31/003 |
| 2008/0197008 | A1 | 8/2008 | Einschenk et al. | |
| 2018/0090288 | A1 | 3/2018 | Famy et al. | |

FOREIGN PATENT DOCUMENTS

| | | |
|---|---|---|
| EP | 3300097 | 3/2018 |
| FR | 1125167 | 10/1956 |
| WO | WO2009093919 | 7/2009 |

OTHER PUBLICATIONS

English Language Machine Translation of German Patent Publication No. DE1083889 dated Jun. 23, 1960, 6 pages.
English Language Machine Translation of French Patent Publication No. FR1125167 dated Oct. 25, 1956, 4 pages.

* cited by examiner

SYSTEM FOR ACTUATING A VACUUM BOTTLE

TECHNICAL FIELD

The present invention relates to a system for actuating a vacuum bottle in order to open an electric circuit in a medium-voltage or high-voltage electrical device, i.e. a device operating at a voltage greater than 1,000 V.

The invention also relates to an electrical device including such an actuating system for at least one of the phases thereof. In the present document, the term electrical device equally denotes several types of device such as an interrupter, a circuit breaker, a contactor, a fuse-switch, a recloser, a disconnector, etc.

BACKGROUND

A medium-voltage or high-voltage electrical device of the type described in EP 2182536 includes a vacuum bottle that is not placed in the main circuit comprising the main switch of a phase of the device, but in a branch parallel with this main switch. Thus, in normal operation when the main switch is closed, no current passes through the vacuum bottle. The bottle is only acted upon during an opening operation of the main circuit, using an opening mechanism of the main switch that makes it possible first to switch the current gradually from the main circuit to the branch, which then makes it possible to open the main switch while the current passes entirely through the vacuum bottle. This is then opened in turn by the opening mechanism. The appearance of an electric switching arc in the main switch during the opening operation is thus avoided, as the vacuum bottle switches the main current.

Due to this architecture, the vacuum bottle receives current only during the opening phase of the main phase circuit, and not during normal operation. In addition, the bottle is not acted upon during a closing operation of the main circuit and it likewise does not have to withstand any short-circuit current. It must just be capable of withstanding a Transient Recovery Voltage (TRV) after the switching of the current in the main circuit.

This results in a vacuum bottle that can advantageously be simplified and designed with a much smaller size than in a conventional architecture, in which the vacuum bottle would be placed in the main circuit of the electrical device.

EP 3300097 already describes a device that makes it possible to drive the moving electrode of a vacuum bottle in such a product. This drive device is actuated by the moving contact of the main switch by means of a moving vane, for example. The drive device then drives the moving electrode towards the open position, by means of an adjusting nut that also enables more accurate adjustment of the movement of the moving electrode. This drive device includes a number of small parts that require accurate mechanical adjustment to obtain satisfactory reproducibility of the system. It can also sometimes generate torsional stresses on the moving electrode.

One of the aims of the invention is therefore to propose a simple solution for such a device for driving a moving electrode that is reliable and economical, and easy to implement. It also aims to minimize the dielectric stresses of the system and likewise minimize the torsional forces that can be applied to the bellows of the moving electrode, particularly during implementation.

SUMMARY

To this end, the invention describes a system for actuating a vacuum bottle of an electrical device, the vacuum bottle comprising a fixed electrode and an electrode that is mobile along a longitudinal axis between a closed position in which the two electrodes are in contact with each other and an open position in which the two electrodes are separated, the actuating system comprising an adjusting nut that is rotatably mobile about the longitudinal axis and is driven by a drive device to perform an opening movement of the moving electrode. According to the invention, the actuating system comprises an adjusting screw that engages with the adjusting nut in order to vary the moment when the drive device drives the moving electrode, the moving electrode is constrained to translate along the longitudinal axis with the adjusting screw, but is free to rotate relative to the adjusting screw, and the rotation of the adjusting screw is limited by blocking means.

According to another feature, the moving electrode includes a transverse groove that extends around the moving electrode and the adjusting screw includes a fastening device that is inserted into the groove. The fastening device includes several fastening clips the ends of which are inserted into the groove.

According to one feature, the actuating system includes a baffle that is placed between the vacuum bottle and the adjusting screw, and which comprises an electrical contact of the electrical spring type electrically connected to the moving electrode, the moving electrode being able to slide relative to the electrical spring. The baffle is fixed to the vacuum bottle with fixing clips and is connected to an external power supply lead.

According to another feature, the blocking means comprise a pin that is fixed to a support of the vacuum bottle, passes through the baffle and blocks the rotation of one of the fastening clips.

According to another feature, the adjusting screw includes an external thread engaging with an internal thread of the adjusting nut.

The invention also describes an electrical device including a main phase switch and such a system for actuating a vacuum bottle placed in parallel with the main phase switch.

In the case of a multiphase electrical device (for example three-phase), which therefore has a main switch for each of the phases, the device preferably includes a vacuum bottle in parallel with each main switch and therefore a vacuum bottle actuating system for each phase.

BRIEF DESCRIPTION OF THE FIGURES

Further features will become apparent from the following detailed description, given with reference to the attached drawings, in which.

DETAILED DESCRIPTION

Figure 1:
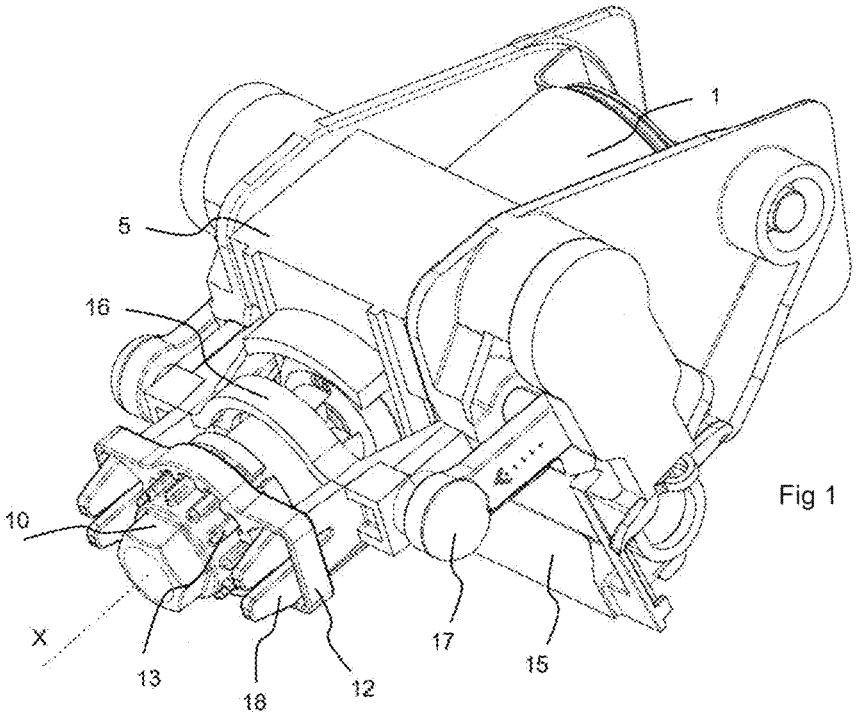
FIG. 1 shows a general perspective view of the mechanism for actuating a vacuum bottle of a phase of an electrical device.
Figure 2:
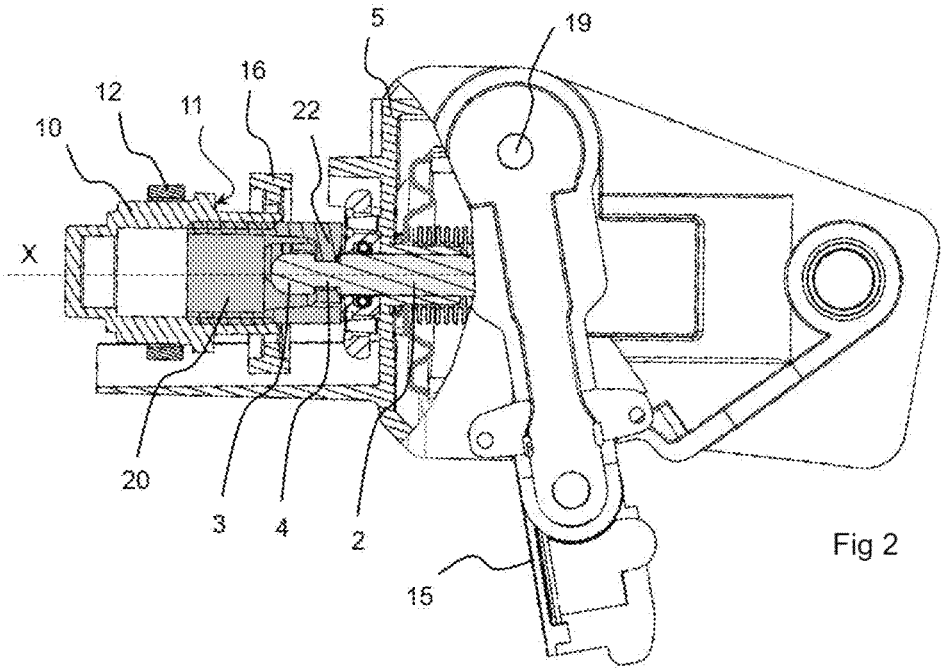
FIG. 2 shows a partial cross-sectional side view of an embodiment of the actuating mechanism according to the invention.
Figure 3:
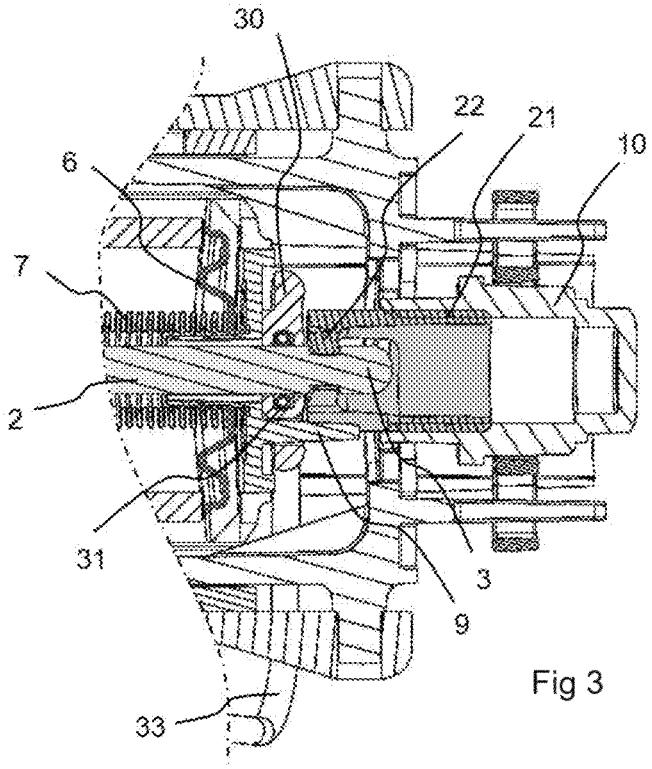
FIG. 3 shows a partial cross-sectional top view of the mechanism in FIG. 2.
Figure 4:
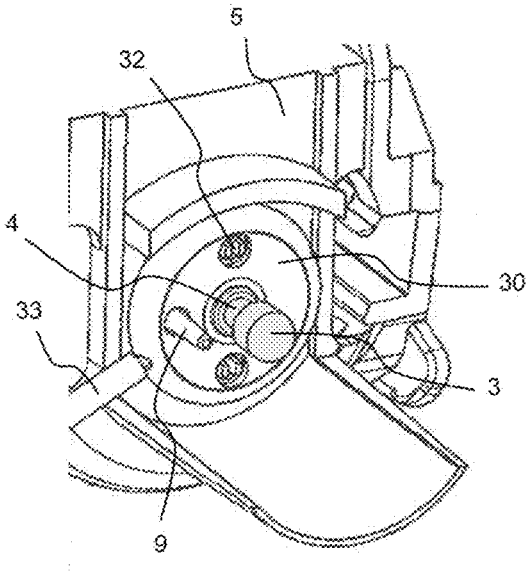
FIG. 4 shows details of an end of the moving electrode without the adjusting screw of the actuating mechanism.

With reference to FIGS. 1 to 3, a medium-voltage or high-voltage electrical device includes a main phase switch and a vacuum bottle 1 that is placed in parallel with the main switch. In a known manner, the vacuum bottle 1 is fixed to an insulating support 5 and includes a conducting moving electrode 2 (also known as a moving rod) and a conducting fixed electrode (also known as a fixed rod and not visible in the figures). The moving electrode 2, which is generally rod-shaped, passes through a cover 6 of the vacuum bottle 1. It is mobile along a longitudinal axis X between a so-called closed position in which the two electrodes are in contact with each other and a so-called open position in which the two electrodes are separated. In all of the figures in the present document, the moving electrode 2 is shown in the closed position.

The vacuum bottle also includes a bellows seal 7 that is fixed to the moving electrode 2 and the cover 6. The bellows 7 is a fragile element, vital for sealing the inside of the vacuum bottle, and any torsion that might be caused for example if a rotational force was applied to the moving electrode 2 must therefore be avoided. In addition, because the proposed architecture of the switching device only requires small vacuum bottles, the bellows seal 7 is therefore particularly fragile.

The moving electrode 2 of the vacuum bottle 1 is driven by an actuating system that makes it possible to perform an opening movement of the vacuum bottle, i.e. to move from the closed position to the open position. To perform the reverse closing movement, i.e. move from the open position to the closed position, the moving electrode 2 can for example be driven by a return spring not shown in the figures.

The actuating system includes a drive device comprising a vane 15 which, during the opening movement, is rotatably mobile about a transverse shaft 19, and a ring 16 that is rigidly connected to the vane 15 by means of two lateral connecting rods 17. During an opening operation of a main phase switch of the electrical connection device, this drive device moves under the action of an opening mechanism of the main phase switch (not shown in the figures) that acts on the vane 15. FIG. 1 thus shows an arrow representing the thrust exerted by the opening mechanism on the vane 15 and the connecting rods 17 during the opening movement of the vacuum bottle 1.

The actuating system also includes an adjusting nut 10 made from an insulating material, which is linked to the moving electrode 2 and is capable of rotating to adjust its position relative to the moving electrode 2, by means of an internal thread. During the opening movement, the ring 16 of the drive device first abuts against a rim 11 of the adjusting nut 10 (see FIG. 2), then pushes the adjusting nut 10 along the axis X in order to pull the moving electrode 2 towards the open position. Advantageously, the adjusting nut 10 therefore serves to both transmit the movement of the opening mechanism to the moving electrode 2, and to adjust in a simple manner the precise moment when the moving and fixed electrodes of the vacuum bottle will separate by acting on the engagement between the adjusting nut 10 and the moving electrode 2.

The link between the adjusting nut 10 and the moving electrode 2 is shown in FIGS. 2 and 3. According to the invention, the actuating system includes an adjusting screw 20 made from an insulating plastic material (for example polyamide 6.6). This adjusting screw 20 has a hollow cylindrical shape and has a first portion provided with an external thread 21 and an opposite second portion provided with a device 22 for fastening the moving electrode 2.

The external thread 21 engages with the internal thread of the adjusting nut 10 to alter the adjustment of the adjusting nut 10 relative to the moving electrode 2. Slightly turning the adjusting nut 10 in one direction or another varies the distance between the ring 16 and the rim 11 of the adjusting nut 10, and therefore varies the moment when the ring 16 will come into contact with the adjusting nut 10 and therefore the moment when the moving electrode 2 will start its opening movement.

The fastening device 22 advantageously makes it possible to constrain the adjusting screw 20 to translate along the longitudinal axis X with the moving electrode 2, while leaving the moving electrode 2 free to rotate about the axis X relative to the adjusting screw 20. Thus, the adjusting screw 20 does not generate any rotational stress on the moving electrode 2 and there is therefore no risk of damage to the bellows seal 7. The bellows seal 7 creates the only rotational stress on the moving electrode 2.

To this end, in the embodiment shown, the moving electrode 2 includes a free end 3 and a transverse groove 4 extending around the rod of the moving electrode 2, close to this end 3. The fastening device consists of several fastening clips 22 the ends of which are inserted into the groove 4 to rigidly connect the adjusting screw 20 and the moving electrode 2.

In the example shown in the figures, the adjusting screw 20 includes three fastening clips 22 that are evenly distributed around the cylinder of the adjusting screw 20, each clip having a width corresponding to an arc of between approximately 30° and 60° (for example around 45°). Having three evenly distributed fastening clips 22 contributes in particular to the satisfactory centring of the adjusting screw 20 relative to the moving electrode 2. The width is selected so that the clips 22 are sufficiently elastic to be inserted into the groove 4 but nonetheless sufficiently strong. Obviously, a different number of clips and/or a different width of clip that was also suitable could be selected for this fastening device. The fastening device therefore provides a simple solution for:

easily mounting and assembling the actuating system on the vacuum bottle due to the elasticity of the clips 22, which makes it possible to insert them very quickly into the groove 4 on mounting, and constraining the adjusting screw 20 and the moving electrode 2 to translate together only without rotational stress, as the ends of the clips 22 can rotate in the groove 4. Any rotation of the adjusting screw 20 is not therefore transmitted to the moving electrode 2.

Preferably, the free end 3 of the moving electrode 2 is rounded, for example hemispherical, so as to avoid edges that could generate dielectric problems.

Figure 5:
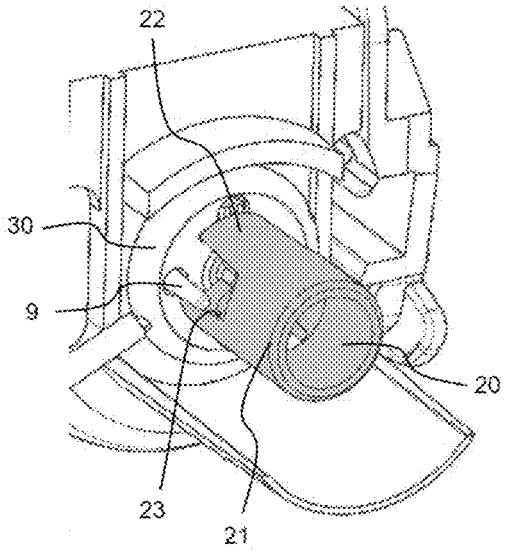
FIG. 5 is the same as FIG. 4 but with the adjusting screw.

The actuating system also includes a metal baffle 30 surrounding the rod of the moving electrode 2. It is placed between the vacuum bottle 1 and the adjusting screw 20 and is for example fixed to the support 5 of the vacuum bottle 1, by means of two fixing clips 32, see in particular FIGS. 3 and 5. This baffle 30 is in the form of a disc, the ends of which are rounded to avoid edges, and is electrically connected to a power supply lead 33. An O-shaped electrical contact of the electrical spring type 31 is fitted inside the baffle 30. This electrical spring 31 is wound around the moving electrode 2, before the groove 4, in order to ensure satisfactory electrical contact, capable for example of carrying 2,000 A at 24 kV for 20 msec, while letting the moving electrode 2 slide, i.e. without causing any rotational stress on the moving electrode 2, again with the aim of preventing damage to the bellows 7.

The baffle 30 is a sort of screen the aim of which is to attenuate the electrical fields in this area in order to provide dielectric protection for the electrical spring and the walls of the vacuum bottle. It also serves to provide, by means of the electrical spring 31, the electrical connection between the moving electrode 2 and the power supply lead 33, which in turn is connected to the main moving contact of the electrical device.

In addition, the actuating system includes blocking means 9 to prevent or limit the rotation of the adjusting screw 20 so that the rotation of the adjusting nut 10 does not result in the rotation of the screw 20. Various solutions can be envisaged for such blocking means. A very simple solution, shown in the embodiment in the figures, consists of a pin 9 protruding from the insulating support 5 of the vacuum bottle 1 and passing through the baffle 30, through an orifice made in the baffle 30. This pin 9 is designed to rest on an inner edge 23 of one of the fastening clips 22 when the adjusting screw 20 is mounted on the moving electrode 2, therefore preventing it from turning in one direction. The rotation of the adjusting screw 20 is also limited in the other direction when the pin 9 comes into contact with the inner edge of another adjacent fastening clip 22. Other blocking means 9 could easily be envisaged.

Finally, the actuating system includes a removable band 12 that makes it possible to fix the position of the adjusting nut 10 relative to the moving electrode 2, once the adjustment has been performed (see FIG. 1). This band 12 is introduced into two lateral protrusions 18 extending on either side of the ring 16. The band 12 can easily snap into the protrusions 18 so that it is held in the blocking position once the adjustment has been performed, and can also be removed easily when an operator wishes to adjust the position of the adjusting nut 10.

Once the band 12 has been snapped in place, the adjusting nut 10 is blocked by notches in the band 12 that engage with teeth 13 of the adjusting nut 10 positioned around the outer periphery thereof to prevent the rotation of the nut 10. The number of teeth/notches determines the size of the angle of adjustment possible between the adjusting nut 10 and the moving electrode 2.

So that the adjusting nut 10 can be turned more easily during adjustment, its end is optionally shaped so that it can be manipulated with a spanner or a tool, such as the hexagonal shape in the example in FIG. 1.

In the case of a multiphase electrical connection device (for example three-phase), which therefore has a main switch for each of the phases, the device preferably includes a vacuum bottle in parallel with each main switch and therefore a vacuum bottle actuating system for each phase, according to the invention. In such a device, the opening mechanism that acts on the vacuum bottle actuating systems can however be common to all of the phases of the device.

The invention claimed is:

1. A system for actuating a vacuum bottle of an electrical device, the vacuum bottle comprising a fixed electrode and a moving electrode that is mobile along a longitudinal axis between a closed position in which the fixed and moving electrodes are in contact with each other and an open position in which the fixed and moving electrodes are separated, the system comprising an adjusting nut that is rotatably mobile about the longitudinal axis and is driven by a drive device to perform an opening movement of the moving electrode wherein:

the system comprises an adjusting screw engaging with the adjusting nut in order to vary a moment when the drive device drives the moving electrode, the adjusting screw comprises a fastening device for fastening the moving electrode so that the moving electrode is constrained to translate along the longitudinal axis with the adjusting screw, but is free to rotate relative to the adjusting screw, a rotation of the adjusting screw is limited by blocking means.

2. The system according to claim 1, wherein the moving electrode includes a transverse groove that extends around the moving electrode and the fastening device is inserted into the groove.

3. The system according to claim 2, wherein the fastening device includes several fastening clips, the fastening clips having ends that are inserted into the groove.

4. The system according to claim 3, wherein the blocking means comprise a pin that blocks a rotation of one of the fastening clips.

5. The system according to claim 4, wherein the system includes a baffle that is placed between the vacuum bottle and the adjusting screw, and which comprises a contact that includes an electrical spring, the contact being electrically connected to the moving electrode, the moving electrode being able to slide relative to the electrical spring, and wherein the pin is fixed to a support of the vacuum bottle and passes through the baffle.

6. The system according to claim 1, wherein the system includes a baffle that is placed between the vacuum bottle and the adjusting screw, and which comprises a contact that includes an electrical spring, the contact being electrically connected to the moving electrode, the moving electrode being able to slide relative to the electrical spring.

7. The system according to claim 6, wherein the baffle is fixed to the vacuum bottle with fixing clips and is connected to an external power supply lead.

8. The system according to claim 1, wherein the moving electrode includes a rounded end.

9. The system according to claim 1, wherein the adjusting screw includes an external thread engaging with an internal thread of the adjusting nut.

10. An electrical device provided with a main phase switch and the vacuum bottle placed in parallel with the main phase switch, wherein the electrical device includes at least the system for actuating the vacuum bottle according to claim 1.

* * * * *